US010389066B2

(12) United States Patent
Armbrecht et al.

(10) Patent No.: US 10,389,066 B2
(45) Date of Patent: Aug. 20, 2019

(54) CODED INSERTION-TYPE CONNECTION ARRANGEMENT

(71) Applicant: ROSENBERGER HOCHFREQUENZTECHNIK GMBH & CO. KG, Fridolfing (DE)

(72) Inventors: Gunnar Armbrecht, Mühldorf am Inn (DE); Stephan Kunz, Chieming (DE); Thomas Müller, Berchtesgaden (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 15/743,878

(22) PCT Filed: Jun. 16, 2016

(86) PCT No.: PCT/EP2016/001005
§ 371 (c)(1),
(2) Date: Jan. 11, 2018

(87) PCT Pub. No.: WO2017/008876
PCT Pub. Date: Jan. 19, 2017

(65) Prior Publication Data

US 2018/0198236 A1 Jul. 12, 2018

(30) Foreign Application Priority Data

Jul. 14, 2015 (DE) ..... 20 2015 005 042 U

(51) Int. Cl.
*H01R 13/642* (2006.01)
*H01R 13/645* (2006.01)
*H01R 13/6463* (2011.01)

(52) U.S. Cl.
CPC ..... *H01R 13/642* (2013.01); *H01R 13/6456* (2013.01); *H01R 13/6463* (2013.01)

(58) Field of Classification Search
USPC ..... 439/176
See application file for complete search history.

(56) References Cited

U.S. PATENT DOCUMENTS 4,781,626 A * 11/1988 Lazarchik ..... H01R 13/64 439/680
6,056,568 A * 5/2000 Arnett ..... H01R 13/6466 200/51.06

(Continued)

FOREIGN PATENT DOCUMENTS

CN 101248561 A 8/2008
CN 104321935 A 1/2015

(Continued)

*Primary Examiner* — Alexander Gilman
(74) *Attorney, Agent, or Firm* — DeLio Peterson & Curcio LLC; Robert Curcio

(57) ABSTRACT

An insertion-type connecting arrangement having at least one first and one second insertion-type connector and an arrangement of insertion points having at least one first and one second insertion point for the insertion of the insertion-type connectors, there being connected to the first insertion-type connector two or more cores laid up at a preset first lay length and to the second insertion-type connector two or more cores laid up at a preset second lay length, having a coding mechanism which allows the first insertion-type connector to be inserted in the first insertion point but not in the second one and which allows the second insertion-type connector to be inserted in the second insertion point but not in the first one.

17 Claims, 3 Drawing Sheets

(56) References Cited

U.S. PATENT DOCUMENTS 6,296,528 B1 * 10/2001 Roberts ..... H01R 13/6456 439/676
7,195,518 B2 * 3/2007 Bert ..... H01R 4/2441 439/290
7,229,309 B2 * 6/2007 Carroll ..... H01R 13/6463 439/418
7,335,066 B2 * 2/2008 Carroll ..... H01R 4/2429 174/27
7,601,024 B2 * 10/2009 Martich ..... H01R 13/506 439/540.1
7,997,941 B2 * 8/2011 Pfaffenbach ..... H01R 13/645 439/680
2003/0077927 A1 * 4/2003 Momota ..... H01R 9/226 439/76.2
2003/0157843 A1 * 8/2003 Thomas ..... H01R 13/64 439/680
2005/0006132 A1 * 1/2005 Clark ..... H01B 7/184 174/113 C
2005/0009409 A1 * 1/2005 Chen ..... H01R 13/518 439/676
2007/0161296 A1 7/2007 Carroll et al.
2008/0305663 A1 * 12/2008 Wang ..... H01R 13/642 439/135
2009/0209140 A1 * 8/2009 Heggemann ..... H01R 13/6453 439/680
2011/0294361 A1 * 12/2011 Schrader ..... H01R 13/64 439/680
2016/0218460 A1 * 7/2016 Zebhauser ..... H01R 13/506

FOREIGN PATENT DOCUMENTS

DE 9309321 11/1993
DE 29520152 2/1996
DE 102008049574 A1 4/2010
DE 102013009330 A1 12/2014
TW 490683 U 11/2014
WO 20060066232 A1 6/2006
WO 20120078824 A2 6/2012
WO 20140020497 A1 2/2014
WO 20150003810 A1 1/2015

* cited by examiner

CODED INSERTION-TYPE CONNECTION ARRANGEMENT

BACKGROUND OF THE INVENTION

1. Field of the Invention

The present invention relates to an insertion-type connecting arrangement comprising at least one first and one second insertion-type connector and an arrangement of insertion points having at least one first and one second insertion point for the insertion of the insertion-type connectors, there being connected to the first insertion-type connector two or more cores laid up at a first preset lay length and to the second insertion-type connector two or more cores laid up at a second preset lay length, a coding mechanism being provided which allows the first insertion-type connector to be inserted in the first insertion point but not in the second insertion point, and which allows the second insertion-type connector to be inserted in the second insertion point but not in the first insertion point.

2. Description of Related Art

Cables having laid-up cores have already long been known in the field of signal and data transmission. An example of such cables is twisted-pair cables which have pairs of cores which are twisted together for transmitting data signals such as, say, differential signals. Another example is cables which have four cores laid up in star-quad.

What is meant by "lay length" is that dimension in the longitudinal direction of the cores or cable which the individual cores laid up in a helix require for one revolution of the helix, i.e., until they return to their original position in the cross section of the cable (a revolution through 360°).

Compared with cables in which the cores are not laid up, cables having laid-up cores give better protection against external electromagnetic fields and electrostatic factors because, when signal transmission is symmetrical due to the twisting of the cores, the influences caused by external fields largely cancel one another out.

Insertion-type connectors such as, say, plugs and sockets are used to connect electrically conductive components such as, say, cables together conductively.

To, for example, transmit quite large volumes of data or to make star-quad connections to different terminal devices, it may be necessary for a plurality of cables having respective laid-up cores to be laid out next to one another and to be fixed via respective insertion-type connectors mounted on the front ends of the cables into associated insertion points belonging to an arrangement of insertion points for the insertion of an insertion-type connector.

WO 2015/003810 A1 describes a system having a plurality of plug-in, i.e. insertion-type, connectors each having two housing or shell parts. The first housing parts are each identical and the second housing parts are different from one another. The plug-in connectors can be fixed into a multiple housing or shell. The plug-in connectors are suitable for the connection of a twisted-pair cable.

DE 10 2013 009 330 A1 describes a contact carrier for connecting a plurality of cores of a cable or a plurality of cables to a mating component, the contact carrier having a plurality of contact-carrier elements which can each be connected to at least one of the cable cores. The contact carrier is characterized by the fact that the contact-carrier elements are coded amongst one another by color and/or by pattern and/or mechanically in such a way as to be assembled into a predefined layout.

WO 2012/078824 A2 describes an electrical insertion connection system wherein a connector is inserted in a complementary connector in the correct orientation. Provided for this purpose is a groove which prevents the connector being inserted into the complementary connector in an incorrect orientation.

In an arrangement of insertion points of this kind, with a view to an advantageous use of space, two or more insertion-type connectors may be inserted next to one another in close proximity in associated insertion points belonging to the arrangement of insertion points, or in other words may be fixed thereto. The arrangement of insertion points may for example be set up in the form of a common shell (a multiple shell) for fixing the individual insertion-type connectors to the insertion points or in the form of a multiple mating insertion-type connector for the insertion of the individual insertion-type connectors for transmitting electrical signals or currents.

However, it has been found that the use of an arrangement of insertion points having a plurality of insertion points arranged next to one another may result in degradation of or interference with the data signals being transmitted, especially when the cores which are laid up with one another do not each have a screen.

SUMMARY OF THE INVENTION

In view of the problem described, it is an object of the present invention to refine, at no great expense or effort, an insertion-type connecting arrangement having a plurality of insertion-type connectors and having a plurality of insertion points for the fixing thereof which are provided in a preset layout in three dimensions, in such a way that the disruption of signals described above is reduced or prevented.

This object is achieved by an insertion-type connecting arrangement as defined in the independent claims. Advantageous refinements of the invention are described in the dependent claims.

The above and other objects, which will be apparent to those skilled in the art, are achieved in the present invention which is directed to an insertion-type connecting arrangement comprising at least one first and one second insertion-type connector and an arrangement of insertion points having at least one first and one second insertion point for the insertion of the insertion-type connectors, there being connected to the first insertion-type connector two or more cores laid up at a preset first lay length and to the second insertion-type connector two or more cores laid up at a preset second lay length, a coding mechanism being provided which allows the first insertion-type connector to be inserted in the first insertion point but not the second insertion point and which allows the second insertion-type connector to be inserted in the second insertion point but not the first insertion point such that the first lay length is different from the second lay length, with cores having different lay lengths being respectively connected to those insertion-type connectors which are assigned to two adjacent insertion points by the coding mechanism.

The insertion-type connecting arrangement includes a third, fourth, fifth, or further insertion-type connectors to respective ones of which two or more cores laid up at a preset lay length are connected, the arrangement of insertion points having a third, fourth, fifth or further insertion points for the insertion of the insertion-type connectors and the coding mechanism allowing each of the insertion-type connectors to be inserted in at least one of the insertion points and not allowing it to be inserted in at least one other of the insertion points.

The coding mechanism allows the individual insertion-type connectors each to be inserted in only precisely one insertion point which is assigned to the insertion-type connector.

The individual insertion-type connectors have shaped portions of different respective shapes, and the insertion points in the arrangement of insertion points which are respectively assigned to the insertion-type connectors have respective complementary shaped portions as a coding mechanism.

The insertion points are substantially identical in form apart from the different shaped portions which act as a coding mechanism.

The arrangement of insertion points takes the form of a multiple shell in one or more pieces or the form of a multiple mating insertion-type connector in one or more pieces, in which the individual insertion points are arranged in a preset layout relative to one another in space.

The insertion points are each arranged next to one another in one or more insertion rows, at a preset distance (A) from the insertion point which is adjacent in the given case. Each insertion-type connector has contact elements which are electrically connected to the laid-up cores connected to it, the distance (A) between respective adjacent insertion points in an insertion row being more than twice as large and less than eight times as large, and in particular approximately four times as large, as a distance (B) between the contact elements belonging to an insertion-type connector.

Respective twisted-pair cables of a preset lay length are connected to the insertion-type connectors.

Cores laid up at different lay lengths are connected to each insertion-type connector.

The different lay lengths are not multiples of one another and their lowest common multiple is preferably more than twice the higher lay length.

The insertion-type connecting arrangement includes markings, such as color markings applied to the insertion-type connectors and the insertion points, to identify at least one insertion point assigned to the given insertion-type connector and/or to identify a lay length assigned to the insertion-type connector or the insertion point.

At least one universal insertion-type connector is so configured that it can be introduced into all the insertion points.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
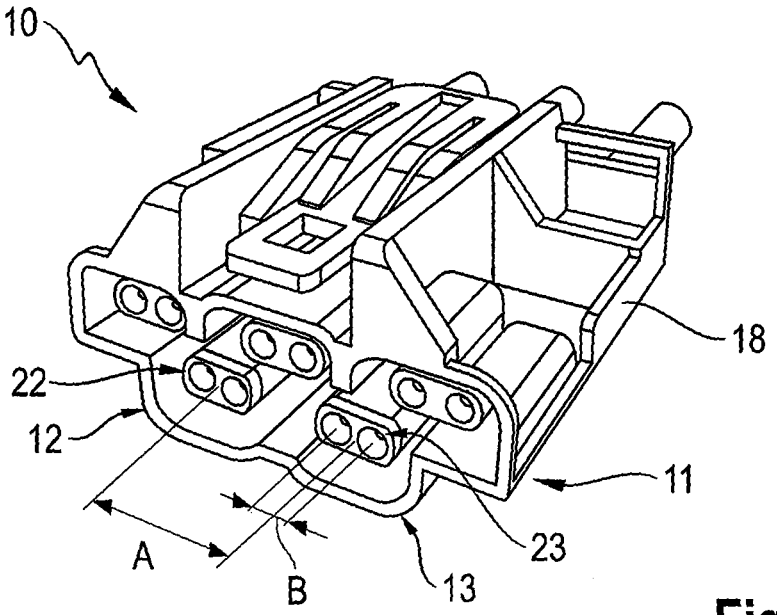
FIG. 1 is a perspective view from the front of a first embodiment of insertion-type connecting arrangement according to the invention.

In describing the preferred embodiment of the present invention, reference will be made herein to FIGS. 1-5 of the drawings in which like numerals refer to like features of the invention.

To achieve an object of the present invention, provision is made in accordance with the invention in an insertion-type connecting arrangement of the above kind for the first lay length to be different from the second lay length, with cores having different lay lengths being respectively connected to those insertion-type connectors which are assigned to two adjacent insertion points by the coding mechanism.

The second lay length may differ in this case from the first lay length by more than 2%, and preferably by more than 5% and in particular by more than 10%. On the other hand, the first lay length should not be a multiple or a divisor of the second lay length, because lay length relationships of this kind would promote crosstalk between the lay-up groupings formed by the cores.

The invention originates from the finding that a given inserted position in an arrangement of insertion points may not be suitable for cores laid up at a given lay length, because for example there are other electrical components arranged in the immediate surroundings of this inserted position which make it possible for there to be coupling or crosstalk of signals between the laid-up cores and the other electrical components. If there is then provided on the arrangement of insertion points a coding mechanism which allows the relevant insertion-type connector to be inserted only at an insertion point which is distant in space from the problematic electrical component, such signal crosstalk and the signal degradation which it involves can be eliminated and the signal quality thereby improved. In other words, the coding mechanism ensures that each insertion-type connector, and the cores coupled thereto which are laid-up at a preset lay length, has assigned to it an insertion point which is particularly advantageous from an electrical point of view in the light of this lay length (an insertion point from which electrical components which allow crosstalk of RF signals between the laid-up cores and the electrical components are more distant in space than from the other insertion points).

What the "assigning" of an insertion-type connector to an insertion point by the coding mechanism is to be understood to mean in accordance with the invention is that the insertion-type connector in question can be properly inserted in the assigned insertion point without being hindered in its insertion by coding means provided on the insertion-type connector and/or at the insertion point. If the arrangement of insertion points has only two insertion points, each of the two insertion-type connectors has one insertion point assigned to it and the other insertion point not so assigned, meaning that it cannot be properly inserted in this other insertion point. If the arrangement of insertion points has more than two insertion points, each one of the two insertion-type connectors, together with the laid-up cores connected to it, has assigned to it at least one insertion point which is particularly suitable in view of the relevant lay length, and at least one other, less suitable, insertion point not so assigned. Each insertion-type connector advantageously has precisely one particularly suitable insertion point assigned to it, thus preventing it from being properly inserted in any of the other insertion points which are less suitable in view of the relevant lay length of the cores connected to the connector.

As explained above, the quality of signal transmission can be improved even with an insertion-type connecting arrangement according to the invention having only two insertion-type connectors, by virtue of the fact that crosstalk between the signals transmitted via the insertion-type connectors and other electrical components is minimized. However, the insertion-type connecting arrangement according to the invention is deployed in a particularly advantageous way if it has a third, fourth, fifth or further insertion-type connectors to respective ones of which two or more cores laid up at a preset lay length are connected, the arrangement of insertion points having a third, fourth, fifth or further insertion points for the insertion of the insertion-type connectors and the coding mechanism allowing each of the insertion-type connectors to be inserted in at least one of the insertion points and not allowing it to be inserted in at least one of the insertion points.

This is because, due to the coding mechanism, two adjacent insertion points can be assigned in this case to two insertion-type connectors between whose cores there is hardly any crosstalk or electrical coupling due to the lay length relationships, by which means the signal quality can be further improved.

In the case of an arrangement of insertion points which has numerous insertion points, particularly high quality can be ensured for the signals to be transmitted by having the coding mechanism allow the individual insertion-type connectors each to be inserted in only precisely one insertion point which is assigned to the insertion-type connector. When this is the case, each insertion-type connector can be inserted only in precisely that insertion point which is particularly suitable from the point of view of position in space and in respect of the electrical signal quality of the RF signals to be transmitted as a whole. If for example there are two lay lengths which tend to cause signal crosstalk, then those insertion points which are assigned to insertion-type connectors having these two lay lengths are arranged to be particularly distant from one another in space. On the other hand, it is advantageously cores which are laid up at different lay lengths and which do not tend to cause signal crosstalk which are respectively connected to those insertion-type connectors which are assigned by the coding mechanism to two adjacent insertion points.

In an insertion-type connecting arrangement which is a particular preference according to the invention, the different lay lengths are not multiples of one another and their lowest common multiple is preferably more than twice the higher lay length. Such insertion-type connectors are in particular assigned to insertion points which are especially distant from one another in space.

The invention is not limited to any given coding mechanism. What has proved particularly advantageous from the point of view of easy provision and reliable operation is a coding mechanism which acts by inter-engagement in which the insertion-type connectors have respective shaped portions such as, say, grooves and/or projections, and the insertion points in the arrangement of insertion points which are respectively assigned to the insertion-type connectors have respective complementary shaped portions such as, say, projections and/or grooves.

Each insertion-type connector preferably has an insertion-type connector shell which, for insertion, can be introduced into at least one associated insertion point in the arrangement of insertion points. The insertion-type connector shell may be in more than one piece and may have for example a first and a second piece of the shell. At least one of the pieces of the shell may have the shaped portions which constitute the coding mechanism, in the form of projections, lower areas, openings, spigots, pins, grooves, channels or the like, which are provided on the outside of the insertion-type connector shell in such a way that they fit together with shaped portions of at least one insertion point in the arrangement of insertion points which are of complementary shapes. Each insertion-type connector shell has for example at a preset position a channel in which a projection at the associated insertion point engages when insertion takes place. By contrast, the channel in an insertion-type connector shell which is not associated with this insertion point is arranged at a different preset position, and thus is not able to be introduced into this insertion point because the projection butts against a stop if insertion is attempted.

In a first embodiment of the invention, all the insertion-type connectors are equipped with different shaped portions. Alternatively, two or more insertion-type connectors are provided with the same shaped portions, which are then each assigned to the same insertion points. Such insertion points are preferably not provided in the multiple shell in positions immediately adjacent to one another but are, if required, far distant from one another in space.

Alternatively, or in addition, at least one universal insertion-type connector may be so configured that it can be introduced into all the insertion points or in other words is assigned to all the insertion points. A universal insertion-type connector of this kind preferably does not have projections which might butt against a stop belonging to a shaped portion of one of the insertion points. However, a universal insertion-type connector of this kind is not necessarily set up for signal transmission.

The insertion-type connectors and/or the insertion points are preferably substantially identical in form apart from the different shaped portions which act as a coding mechanism. The insertion-type connector shells for example preferably each comprise a first and a second shell part, with the first shell parts each being identical in form and the second shell parts each having the shaped portions which, if required, are different. In this connection, attention is directed to printed publication WO 2015/003810 A1, the disclosure content of which relating to the construction of the arrangement of insertion points and the insertion-type connectors is hereby incorporated in its entirety in the present description by reference.

The invention gives particular advantages where the insertion points in the arrangement of insertion points are arranged next to one another in close proximity, because the risk of crosstalk in the event of an adverse insertion pattern is particularly high when this is the case. The insertion points may each be arranged at a preset distance of, preferably, 2 cm or less, 1 cm or less, and in particular of approximately 0.7 cm, from the respective insertion point which is adjacent in an insertion row and/or from the closest insertion point in a neighboring insertion row. The distance is measured in this case between the centers of the two insertion points.

The arrangement of insertion points preferably has the insertion points in a preset layout relative to one another in space on an insertion-point carrier in one piece or in more than one piece. The arrangement of insertion points may for example take the form of a multiple shell in which the individual insertion-type connectors can be fixed in position at respective preset positions (at respective insertion points). The multiple shell is for example in the form of a molding of plastics material in one or more pieces. The multiple shell, together with the insertion-type connectors which are fixed into it in at insertion points in a preset insertion pattern, may then be inserted in, for example, a multiple mating insertion-type connector or the like.

In an alternative embodiment, the arrangement of insertion points takes the form of a multiple mating insertion-type connector which may have a plurality of mating insertion-type connectors, which are integrated into one another or connected to one another, for coupling to the insertion-type connectors to transmit electrical signals and/or currents. The individual insertion points are formed in this case by the respective mating insertion-type connectors. The multiple mating insertion-type connector may have one common shell for mating insertion-type connectors or a plurality of such shells which are connected together. The shaped portions constituting the coding mechanism may be provided on the respective shells of the mating insertion-type connectors. The multiple mating insertion-type connector may be used as a multiple mating insertion-type connector for mounting on a printed circuit board, and hence as an interface between the contacts on a printed circuit board and a plurality of cables each having laid-up cores.

In another possible embodiment, the arrangement of insertion points is set up in the form of a plurality of individual mating insertion-type connectors which are fixed to a support such as, say, a printed circuit board in a preset layout relative to one another in space. The individual mating insertion-type connectors of the arrangement of insertion points may for example be mounted on a printed circuit board next to one another in one or more rows and may act as an interface between the printed circuit board and a plurality of cables having laid-up cores.

A particularly compact arrangement of insertion points having a large number of insertion points in a small space can be provided by giving it a plurality of rows of insertion points extending parallel to one another, with each row of insertion points having two, three or more insertion points arranged next to one another. The insertion points in adjacent rows may be arranged to be staggered relative to one another in this case, to further increase the degree of compactness.

Each insertion-type connector preferably has at least two contact elements for transmitting electrical currents and/or signals, which are electrically connected to the cores connected to the insertion-type connector. With a view to optimum electrical properties in signal transmission while crosstalk is minimized, it has proved advantageous for the distance between any two adjacent insertion points in an insertion row to be more than twice as large and less than eight times as large as a distance between any two adjacent contact elements belonging to an insertion-type connector. In an embodiment which is a particular preference, the ratio between the distance between two adjacent insertion points and the distance between two contact elements in an insertion-type connector is more than 3:1 and less than 6:1 and in particular is approximately 4:1 or approximately 5:1.

In an embodiment of the invention which is a particular preference, respective twisted-pair cables are connected to the insertion-type connectors, with each twisted-pair cable preferably having precisely one pair of cores twisted at a preset lay length. The twisting preferably extends in the longitudinal direction of the cable in this case, with a lay length which remains the same and is substantially constant.

Crosstalk between the individual laid-up cores or between the twisted pairs of cores may be prevented in a particular effective way if cores laid up in the respective cases at different lay lengths are connected to the insertion-type connectors. What is meant by "different" lay lengths in this case is lay lengths which differ from one another by 2% or more, and preferably 5% or more, and in particular 10% or more.

With a view to easy handling when the insertion-type connectors are being inserted in the insertion points in the arrangement of insertion points, it has proved useful for respective markings, such as color markings say, to be applied to the insertion-type connectors and the insertion points to identify at least one insertion point assigned to the given insertion-type connector and/or to identify a lay length assigned to the insertion-type connector or the insertion point. Alternatively, or in addition, the cores, or rather the cables formed by the cores, may also carry respective markings such as color markings, say, which identify the lay length of the laying-up of the cable.

In a preferred embodiment, each lay length has assigned to it a specific marking such as a specific color marking say, in which case the cable which has this lay length, the insertion-type connector to be connected to the end of this cable and the insertion point assigned to this insertion-type connector may carry this color marking.

The individual insertion-type connectors and the laid-up cores connected thereto may in addition have respective separate screens in for example the form of shared wire braiding extending round the cores or a shared film screen extending round the cores. Screening is not however always necessary because crosstalk between the laid-up cores is already minimized by the coding mechanism.

With a view to the optimizing of signal quality, it has also proved useful for there to be arranged between the laid-up cores connected to the individual insertion-type connectors or between the cables connected to the insertion-type connectors' spacers for increasing a minimum distance between them. Spacers of this kind may be provided in the form of sleeve-type parts or additional cable sheaths such as are described in German utility model DE 20 2014 003 291 UI, the disclosure content of which is hereby incorporated in its entirety in the present description by reference.

In the description which now follows, the invention is explained by reference to the accompanying drawings.

Figure 2:
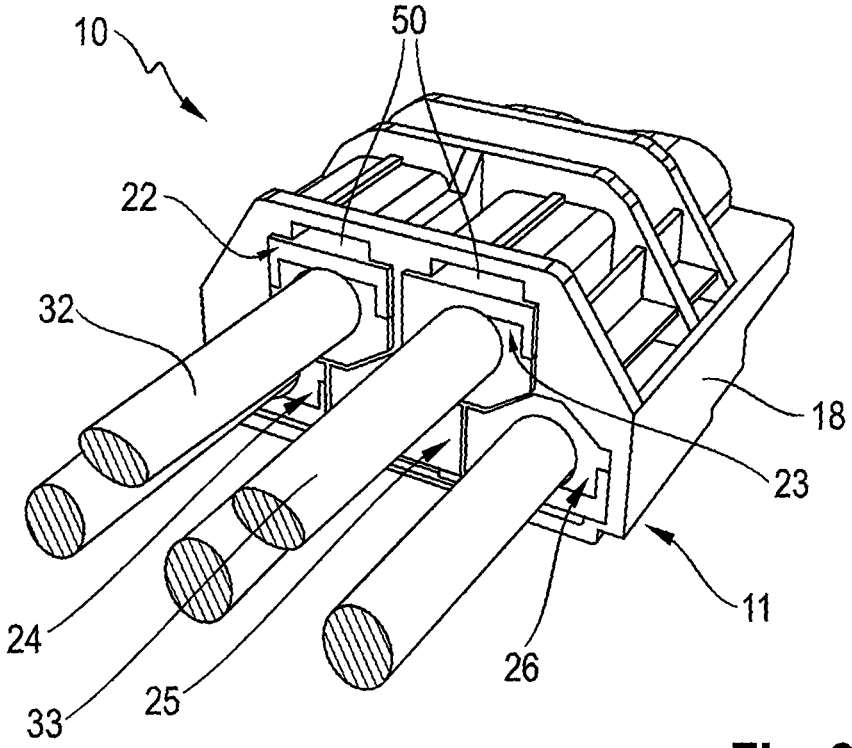
FIG. 2 is a perspective view from the rear of the insertion-type connecting arrangement shown in FIG. 1.

In FIGS. 1 and 2, an insertion-type connecting arrangement 10 according to the invention is shown from the front (FIG. 1) and from the rear (FIG. 2). The insertion-type connecting arrangement comprises an arrangement 11 of insertion points in the form of a multiple shell 18 having a total of five insertion points, of which a first insertion point is indicated by reference numeral 12 and a second insertion point by reference numeral 13. The multiple shell 18 takes the form of a one-piece molding of plastics material. The insertion points are intended for the insertion of insertion-type connectors in the multiple shell 11 in order for the insertion-type connectors to be thereby held in a preset layout and to be fixed in position in space.

In the embodiment shown, the five insertion points are arranged in two rows of insertion points in the multiple shell 18 which are arranged one above another, with the upper row of insertion points having three insertion points arranged next to one another at a distance A in each case and the lower row of insertion points having the two insertion points 12 and 13, which are likewise arranged next to one another at the distance A. With a view to great compactness and only a small space occupied, the insertion points in the two rows of insertion points are arranged with a stagger relative to one another. The distance A between two adjacent insertion points in a row of insertion points is preferably short and is less than 1 cm, and in particular, in the case shown, is approximately 7 mm.

The invention is not however limited to such an arrangement of insertion points and such a number thereof and an arrangement 11 of insertion points in the form of a multiple shell may, as an alternative, have only two, three or four, or more than five, insertion points which are arranged in only one row of insertion points or in more than two rows of insertion points. Other arrangements of insertion points in one common mounting are also conceivable.

The insertion-type connecting arrangement 10 also has five insertion-type connectors, namely a first insertion-type connector 22, a second insertion-type connector 23, a third insertion-type connector 24, a fourth insertion-type connector 25, and a fifth insertion-type connector 26. Connected to each insertion-type connector 22, 23, 24, 25, 26 is a twisted-pair cable having two cores twisted at a preset (constant) lay length. The cores which are twisted at the first preset lay length, which are connected to the first insertion-type connector 22, are indicated by reference numeral 32, and the cores which are twisted at the second preset lay length, which are connected to the second insertion-type connector 23, are indicated by reference numeral 33. The first lay length is different from the second lay length.

Each insertion-type connector also has two contact elements for transmitting electrical currents and/or signals which are electrically connected to respective ones of the cores connected to the given insertion-type connector. In FIG. 1, the distance between the two contact elements of the second insertion-type connector 23 in a direction extending transversely to the direction of insertion is indicated by reference numeral B. The distances between the two contact elements of all the insertion-type connectors 22, 23, 24, 25, 26 are substantially the same and are likewise B.

The ratio between the distance A between adjacent insertion points 12, 13 and the distance B between the two contact elements of the individual insertion-type connectors is approximately 4:1 or approximately 5:1. In the first embodiment which is shown by way of example in FIG. 1, the distance A is 7.2 mm and the distance B is either 1.8 mm (a ratio of exactly 4:1) or 1.5 mm (a ratio of 4.8:1).

The insertion-type connecting arrangement 10 according to the invention has a coding mechanism which allows the first insertion-type connector 22 to be inserted in the first insertion point 12 but not in the second insertion point 13, and which allows the second insertion-type connector 23 to be inserted in the second insertion point 13 but not in the first insertion point 12. The first insertion-type connector 22 is assigned only to the first insertion point 12 and does not fit into any other of the five insertion points. In the same way, the second insertion-type connector 23 is assigned only to the second insertion point 13 and does not fit into any other of the five insertion points. The same applies, mutatis mutandis, to the third to fifth insertion-type connectors 24 to 26.

For this purpose, on the one hand the shells of the insertion-type connectors and on the other hand wall portions of the insertion points which are situated inside the multiple shell have respective shaped portions which form the coding mechanism. The shaped portions comprise respective preset patterns of projections 122 and lower areas 124 which are shown by way of example in FIG. 5 for the insertion-type connectors 22, 23, 24, 25, 26. The shaped portions of the insertion-type connectors and the insertion points assigned thereto are of respective shapes which are complementary to one another, which means that they inter-engage in one another but do not obstruct one another if the insertion-type connector is pushed axially into the insertion point respectively assigned to it from the rear side of the multiple shell 18 which is shown in FIG. 2. The shaped portions of the insertion points do on the other hand prevent the pushing-in of an unassigned insertion-type connector.

Apart from the shaped portions of different respective configurations, the insertion-type connectors and their shells are of substantially identical forms.

The insertion-type connectors and the insertion points respectively assigned to them have in addition markings 50 in the form of color markings, thus enabling it to be seen at first glance which insertion-type connector is assigned to which insertion point and which is not, which makes the insertion operations easier. In the table seen in FIG. 5, it is shown that each of the five insertion-type connectors having different shaped portions is identified by a given color. In addition, the laid-up cores or twisted-pair cables may also have respective markings, such as color markings say, which identify the lay length of the respective laying-up. By connecting the cables to respective insertion-type connectors identified by the same color and by inserting the insertion-type connectors in respective insertion points identified by the same color, it is possible in accordance with the invention to provide an insertion-type connecting arrangement via which RF signals and other data signals can be transmitted with little interference and with a high signal quality.

In accordance with the invention, this is because those insertion-type connectors which are assigned by the coding mechanism to two adjacent insertion points have cores having different lay lengths arranged on them, which means that hardly any crosstalk can take place between adjacent twisted-pair cables after the insertion-type connectors have been inserted. The lay lengths of insertion-type connectors able to be inserted in adjacent positions are preferably also not a multiple of one another. If a plurality of insertion points having identically shaped portions is provided, then they are preferably arranged far away from one another in space, meaning that hardly any crosstalk can take place between the insertion-type connectors connected thereto which have cores laid up at the same lay length.

Figure 5:
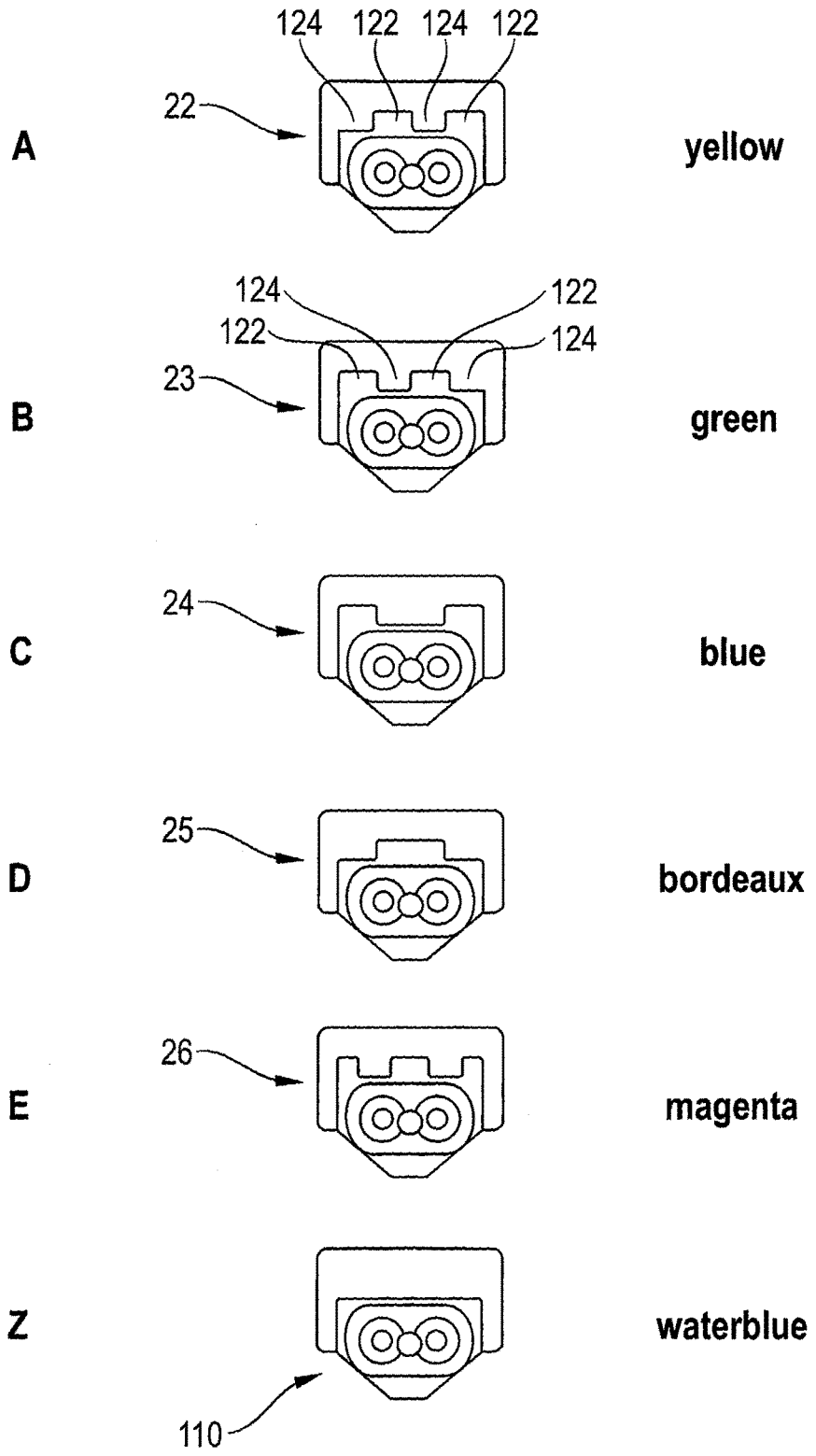
FIG. 5 is a table in which the shaped portions of five insertion-type connectors and one universal connector are shown in diagrammatic form.

The insertion-type connector identified by reference numeral 110 in FIG. 5 is a universal insertion-type connector whose shell is so shaped that it can be inserted in all five insertion points. This is because the universal insertion-type connector 110 does not have any projections 122 which might butt against a projecting shaped portion of one of the insertion points. The universal insertion-type connector 110 does not necessarily have a twisted-pair cable or some other data cable connected to it.

The arrangement 11 of insertion points of an insertion-type connecting arrangement 10 according to the invention does not necessarily take the form of a one-piece multiple shell 18. Instead, the arrangement 11 of insertion points may also comprise a plurality of individual shells which are arranged, or which are connected together, next to one another in a preset layout in space.

Figure 3:
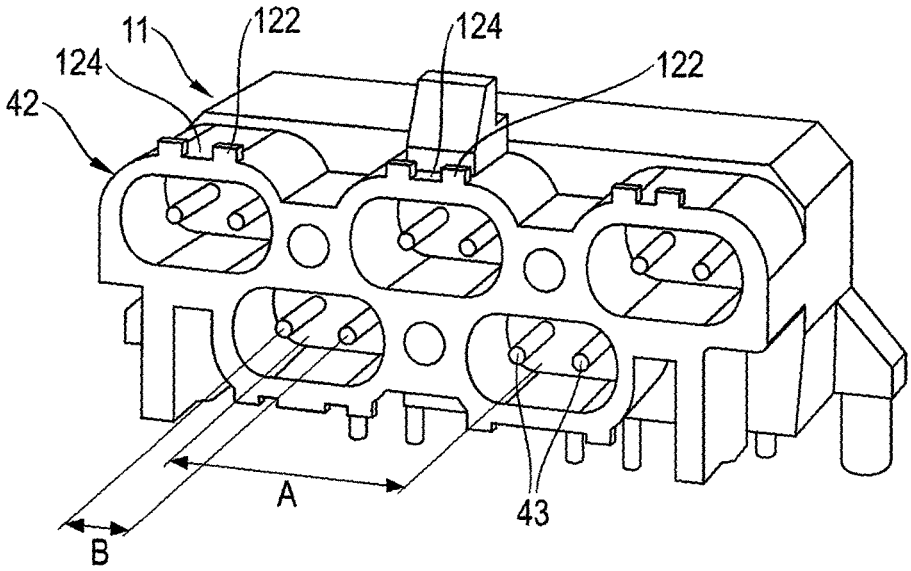
FIG. 3 is a perspective view of an arrangement of insertion points which forms a second embodiment of the invention.

Alternatively, the arrangement 11 of insertion points of an insertion-type connecting arrangement according to the invention may take the form of a multiple mating insertion-type connector 42 such as is shown by way of example in FIG. 3. The multiple mating insertion-type connector 42 here takes the form by way of example of a multiple mating insertion-type connector for printed circuit boards and is set up for coupling to a printed circuit board. The multiple mating insertion-type connector 42 has a total of five insertion points which are arranged next to one another in two insertion rows. Each of the five insertion points has two mating contact elements 43 for electrical coupling to the contact elements of a respective insertion-type connector. The distance A between two adjacent insertion points is preferably approximately four times or approximately five times as great as the distance B between the two mating contact elements 43 of an insertion point.

The insertion-type connectors are not shown in FIG. 3 but they may be the same as the five insertion-type connectors 22, 23, 24, 25, 26 shown in FIG. 1. Formed on a shell of the multiple mating insertion-type connector 42 are shaped portions in the form of grooves 124 and/or projections 122 which form the coding mechanism by which it is ensured that only the assigned insertion-type connector can be inserted in each of the insertion points.

Alternatively, the multiple mating insertion-type connector may have a shell in more than one piece, in which case the individual pieces of the shell are connected together.

Figure 4:
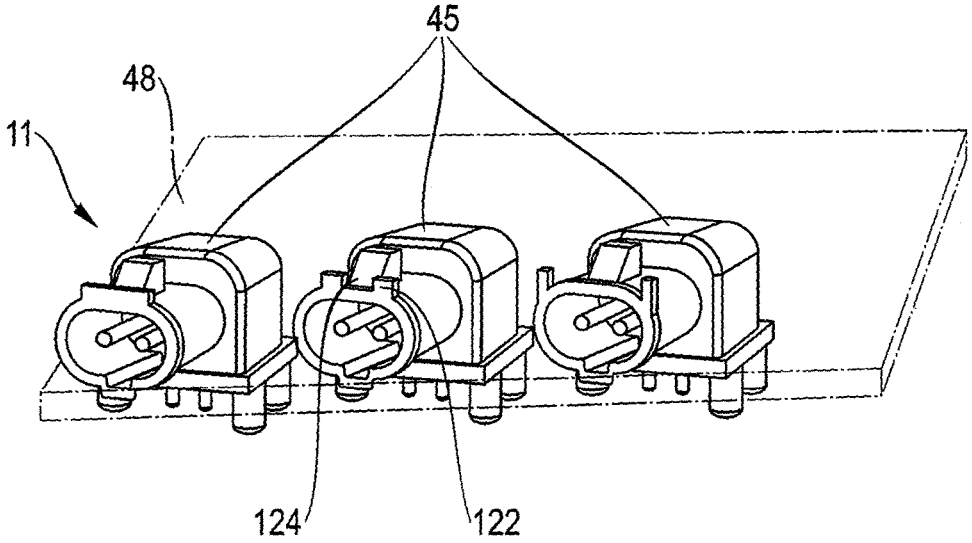
FIG. 4 is a perspective view of an arrangement of insertion points which forms a third embodiment of the invention.

The arrangement 11 of insertion points of a third embodiment of the invention is shown in FIG. 4. In this embodiment the arrangement 11 of insertion points comprises a plurality of mating insertion-type connectors 45 which each form an insertion point and which are fastened to a common support such as a printed circuit board 48 say in a preset layout in space. In this case too the coding mechanism is formed by grooves 124 and/or projections 122 which are arranged on the shells of the mating insertion-type connectors 45.

The associated insertion-type connectors are not shown but they may be the same as the insertion-type connectors shown in FIG. 1.

The exact number of insertion points and their layout relative to one another are not limited to the examples shown in the respective cases and, as required, more or fewer insertion points may be provided in the particular arrangement of insertion points concerned. In each case it is ensured by the coding mechanism that the insertion-type connectors can be inserted into the arrangement of insertion points only in preset insertion patterns which are particularly advantageous in respect of the electrical properties at the time of current and/or signal transmission. What in particular can thereby be avoided is cores laid up at the same lay length being arranged immediately adjacent to one another.

LIST OF REFERENCE NUMERALS

10 Insertion-type connecting arrangement
11 Arrangement of insertion points
12, 13 First and second insertion points
22, 23, 24, 25, 26 First to fifth insertion-type connectors
18 Multiple shell
32 Cores laid up at the first lay length
33 Cores laid up at the second lay length
42 Multiple mating insertion-type connector
43 Mating contact elements
45 Mating insertion-type connector
48 Printed circuit board
50 Markings
110 Universal insertion-type connector
122 Projections
124 Grooves
A Distance between two adjacent insertion points
B Distance between two contact elements of an insertion-type connector While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An insertion-type connecting arrangement comprising at least one first and one second insertion-type connector and an arrangement of insertion points having at least one first and one second insertion point for the insertion of the insertion-type connectors, there being connected to the first insertion-type connector two or more cores laid up at a preset first lay length and to the second insertion-type connector two or more cores laid up at a preset second lay length, a coding mechanism being provided which allows the first insertion-type connector to be inserted in the first insertion point but not the second insertion point and which allows the second insertion-type connector to be inserted in the second insertion point but not the first insertion point such that the first lay length is different from the second lay length, with cores having different lay lengths being respectively connected to those insertion-type connectors which are assigned to two adjacent insertion points by the coding mechanism.

2. The insertion-type connecting arrangement of claim 1, including a third, fourth, fifth or further insertion-type connectors to respective ones of which two or more cores laid up at a preset lay length are connected, the arrangement of insertion points having a third, fourth, fifth or further insertion points for the insertion of the insertion-type connectors and the coding mechanism allowing each of the insertion-type connectors to be inserted in at least one of the insertion points and not allowing it to be inserted in at least one other of the insertion points.

3. The insertion-type connecting arrangement of claim 2, wherein the coding mechanism allows the individual insertion-type connectors each to be inserted in only precisely one insertion point which is assigned to the insertion-type connector.

4. The insertion-type connecting arrangement of claim 1, wherein the individual insertion-type connectors have shaped portions of different respective shapes, and the insertion points in the arrangement of insertion points which are respectively assigned to the insertion-type connectors have respective complementary shaped portions as a coding mechanism.

5. The insertion-type connecting arrangement of claim 4, wherein the insertion-type connectors and/or the insertion points are substantially identical in form apart from the different shaped portions which act as a coding mechanism.

6. The insertion-type connecting arrangement of claim 1, wherein the arrangement of insertion points takes the form of a multiple shell in one or more pieces or the form of a multiple mating insertion-type connector in one or more pieces, in which the individual insertion points are arranged in a preset layout relative to one another in space.

7. The insertion-type connecting arrangement of claim 1, wherein the insertion points are each arranged next to one another in one or more insertion rows, at a preset distance (A) from the insertion point which is adjacent in the given case.

8. The insertion-type connecting arrangement of claim 7, wherein each insertion-type connector has contact elements which are electrically connected to the laid-up cores connected to it, the distance (A) between respective adjacent insertion points in an insertion row being more than twice as large and less than eight times as large, and in particular approximately four times as large, as a distance (B) between the contact elements belonging to an insertion-type connector.

9. The insertion-type connecting arrangement of claim 1, wherein respective twisted-pair cables of a preset lay length are connected to the insertion-type connectors.

10. The insertion-type connecting arrangement of claim 1, wherein cores laid up at different lay lengths are connected to each insertion-type connector.

11. The insertion-type connecting arrangement of claim 1, wherein the different lay lengths are not multiples of one another and their lowest common multiple is preferably more than twice the higher lay length.

12. The insertion-type connecting arrangement of claim 1, including markings, such as color markings applied to the insertion-type connectors and the insertion points, to identify at least one insertion point assigned to the given insertion-type connector and/or to identify a lay length assigned to the insertion-type connector or the insertion point.

13. The insertion-type connecting arrangement of claim 1, wherein at least one universal insertion-type connector is so configured that it can be introduced into all the insertion points.

14. The insertion-type connecting arrangement of claim 3, wherein the individual insertion-type connectors have shaped portions of different respective shapes, and the insertion points in the arrangement of insertion points which are respectively assigned to the insertion-type connectors have respective complementary shaped portions as a coding mechanism.

15. The insertion-type connecting arrangement of claim 4, wherein the shaped portions of the different respective shapes comprise grooves and/or projections and the insertion points in the arrangement of insertion points, which are respectively assigned to the insertion-type connectors, have respective complementary shaped portions comprising projections and/or grooves as a coding mechanism.

16. The insertion-type connecting arrangement of claim 15, wherein the arrangement of insertion points takes the form of a multiple shell in one or more pieces or the form of a multiple mating insertion-type connector in one or more pieces, in which the individual insertion points are arranged in a preset layout relative to one another in space.

17. The insertion-type connecting arrangement of claim 1, wherein the different lay lengths are not multiples of one another and their lowest common multiple is preferably more than twice the higher lay length, and wherein there are respectively connected cores of different lay lengths to those insertion type connectors which are assigned to two adjacent insertion points by the coding mechanism.

* * * * *